US012768362B2

(12) United States Patent
Randall et al.

(10) Patent No.: US 12,768,362 B2
(45) Date of Patent: Oct. 20, 2026

(54) MEASURED RADIAL RESISTOR GRID FAN SPEED AND CONTROL

(71) Applicant: Caterpillar Inc., Peoria, IL (US)

(72) Inventors: Jacob Dean Randall, Peoria, IL (US); Dennis Christopher Agee, Newark, TX (US)

(73) Assignee: Caterpillar Inc., Peoria, IL (US)

( * ) Notice: Subject to any disclaimer, the term of this patent is extended or adjusted under 35 U.S.C. 154(b) by 175 days.

(21) Appl. No.: 18/507,577

(22) Filed: Nov. 13, 2023

(65) Prior Publication Data

US 2025/0154957 A1 May 15, 2025

(51) Int. Cl.

| | |
|---|---|
| ***F04D 27/00*** | (2006.01) |
| ***F04D 25/06*** | (2006.01) |
| ***F04D 25/08*** | (2006.01) |
| ***F04D 29/58*** | (2006.01) |

(52) U.S. Cl.

CPC ..... *F04D 27/004* (2013.01); *F04D 25/06* (2013.01); *F04D 25/08* (2013.01); *F04D 27/001* (2013.01); *F04D 29/582* (2013.01)

(58) Field of Classification Search

CPC ..... F04D 25/06; F04D 25/08; F04D 27/001; F04D 27/004; F04D 29/582–584; F04D 19/002; F04D 25/166; F04D 29/5806–5813; B60L 7/02–08; B60L 7/22; H02P 3/12; H02P 3/22

See application file for complete search history.

(56) References Cited

U.S. PATENT DOCUMENTS

| | | | | |
|---|---|---|---|---|
| 6,749,043 | B2 * | 6/2004 | Brown | F04D 29/541 188/71.6 |
| 6,847,187 | B2 * | 1/2005 | Kumar | H02H 7/0852 361/37 |
| 7,746,604 | B2 | 6/2010 | Mcnally et al. | |
| 9,738,159 | B2 * | 8/2017 | Nikolov | B60L 1/02 |

(Continued)

FOREIGN PATENT DOCUMENTS

| | | | | |
|---|---|---|---|---|
| CN | 111102220 A | * | 5/2020 | F04D 29/002 |
| CN | 113931858 A | * | 1/2022 | F04D 27/001 |

(Continued)

*Primary Examiner* — Alexander B Comley

(74) *Attorney, Agent, or Firm* — Foley & Lardner LLP (Dallas)

(57) ABSTRACT

A system includes: a resistor grid electrically coupled to a motor of an electric drive machine; a fan including a plurality of fan blades rotatably coupled to a fan motor; a speed sensor configured to measure a rotational speed of the fan; and a control circuit including one or more processors and a memory structured to store instructions that, when executed by the one or more processors, cause the control circuit to: determine an active cooling capacity of the fan according to the measured rotational speed of the fan while the fan motor is in an active cooling mode; determine a passive cooling capacity of the fan according to the measured rotational speed of the fan after the fan motor is switched from the active cooling mode to an off mode; control power to the fan motor to provide a target cooling load according to the active cooling capacity of the fan and the passive cooling capacity of the fan.

23 Claims, 9 Drawing Sheets

(56) References Cited

U.S. PATENT DOCUMENTS

| | | | | |
|---|---|---|---|---|
| 2009/0293760 | A1* | 12/2009 | Kumar | B60L 7/10 318/471 |
| 2011/0022276 | A1* | 1/2011 | Thaduvayi | B60T 7/122 701/36 |
| 2012/0132490 | A1* | 5/2012 | Wang | B60L 7/06 188/159 |
| 2012/0230843 | A1* | 9/2012 | Ravipati | H01M 10/39 417/46 |
| 2013/0075170 | A1* | 3/2013 | Minoshima | B60K 11/00 903/902 |
| 2015/0328992 | A1* | 11/2015 | Amaravadi | B60L 7/22 701/70 |
| 2017/0015201 | A1* | 1/2017 | Crosman, III | G01L 5/13 |
| 2018/0045206 | A1* | 2/2018 | Birk | F04D 27/001 |
| 2020/0122550 | A1* | 4/2020 | Petrak | F04D 27/004 |
| 2020/0223459 | A1* | 7/2020 | Wolff | H02K 9/00 |

FOREIGN PATENT DOCUMENTS

| | | | | |
|---|---|---|---|---|
| DE | 102005058922 | A1 * | 1/2007 | B60L 7/22 |
| DE | 102020004797 | A1 * | 2/2021 | H01C 7/02 |
| FR | 2157632 | A5 | 6/1973 | |
| GB | 1411987 | A * | 10/1975 | F04D 25/02 |
| JP | 2018149882 | A * | 9/2018 | |

* cited by examiner

MEASURED RADIAL RESISTOR GRID FAN SPEED AND CONTROL

TECHNICAL FIELD

The present invention relates generally to the field of a resistor grid assembly for a resistive braking system for an electric drive machine, and more particularly to improved systems and methods of operating such resistor grid assemblies.

BACKGROUND

Resistor grid systems used for dynamic braking in machines, such as, electric and diesel-electric locomotives, off-highway machines, and other heavy equipment, are well known. Electric drive motors generate current during the braking of the machine, and a resistor grid system includes a plurality of resistor elements to dissipate the generated electric power as heat. Thus, the resistor grid system may supplement the friction-based brakes and minimize the wear in friction-based braking components of the machine.

The capacity of a resistor grid to dissipate heat is driven by convective heat transfer provided by a fan coupled to the resistor grid. When the grid is under a power load, the fan operates at high speed to maximize the capacity of the resistor grid. When the power load has been removed from the grid, the fan continues to operate for some time afterward to ensure that the grid elements have been cooled. The rapid acceleration of the fan to the high operating speed and the frequent toggling of the fan motor can cause substantial wear and tear, requiring frequent maintenance. Running the fan for longer than is necessary also generates unneeded noise pollution. Improved resistor grid system designs and control systems are needed to increase the longevity of resistive braking systems and to allow for maximum braking capacity under varied operating conditions.

SUMMARY

A first aspect provided herein relates to a system including a resistor grid electrically coupled to a motor of an electric drive machine, a fan including a plurality of fan blades rotatably coupled to a fan motor, a speed sensor configured to measure a rotational speed of the fan, and a control circuit comprising one or more processors and a memory structured to store instructions that, when executed by the one or more processors, cause the control circuit to: determine an active cooling capacity of the fan according to the measured rotational speed of the fan while the fan motor is in an active cooling mode; determine a passive cooling capacity of the fan according to the measured rotational speed of the fan after the fan motor is switched from the active cooling mode to an off mode; control power to the fan motor to provide a target cooling load according to the active cooling capacity of the fan and the passive cooling capacity of the fan.

In some embodiments, the speed sensor includes a gear tooth sensor, an optical sensor, a magneto-resistive sensor, a Hall-effect sensor, or a combination thereof. In some embodiments, the speed sensor is at least partially provided on one or more of a fan rotor, the fan motor, or one or more of the fan blades.

In some embodiments, the control circuit is further configured to determine the active cooling capacity of the fan and the passive cooling capacity of the fan according to at least one of a temperature and a density of an ambient air. In some embodiments, the control circuit is further configured to provide a signal corresponding to a target fan speed to the fan motor. In some embodiments, the control circuit is further configured to provide a signal corresponding to a target fan power to the fan motor. In some embodiments, the control circuit is further configured to determine a resistive capacity of the resistor grid according to the active cooling capacity of the fan and the passive cooling capacity of the fan. In some of these embodiments, the resistive capacity is one of a peak resistive capacity and a continuous resistive capacity. In some embodiments, the control circuit is configured to determine the passive cooling capacity of the fan according to the measured rotational speed of the fan after the fan motor is switched from the active cooling mode to an off mode, based on residual rotation of the fan from a first time instance in which the fan motor is switched to the off mode to a second time instance in which the fan is at rest.

A second aspect provided herein relates to a method of operating an electric drive machine, the method including: determining, by one or more processors, an active cooling capacity of a fan coupled to an air-cooled resistor grid, wherein the active cooling capacity of the fan is determined when the fan is in an active cooling mode; determining, by the one or more processors, a passive cooling capacity of the fan coupled to an air-cooled resistor grid, wherein the passive cooling capacity of the fan is determined after the fan is switched from the active cooling mode to an off mode; determining, by the one or more processors, a target cooling load for the air-cooled resistor grid; and controlling power to the fan to provide the target cooling load to the air-cooled resistor grid according to the active cooling capacity of the fan and the passive cooling capacity of the fan.

In some embodiments, the method also includes measuring a temperature of an ambient air, wherein the passive cooling capacity and the active cooling capacity of the fan is determined according to the temperature of the ambient air. In some embodiments, the passive cooling capacity and the active cooling capacity of the fan is determined according to a density of the ambient air. In some embodiments, the method also includes determining, by the one or more processors, a resistive capacity of the air-cooled resistor grid according to the active cooling capacity of the fan and the passive cooling capacity of the fan. In some embodiments, the passive cooling capacity of the fan is determined according to a measured rotational speed of the fan after the fan is switched from the active cooling mode to an off mode, based on residual rotation of the fan from a first time instance in which the fan is switched to the off mode to a second time instance in which the fan is at rest.

A third aspect provided herein relates to an electric drive machine including: a resistor grid electrically coupled to a motor of the electric drive machine, a fan including a plurality of fan blades rotatably coupled to a fan motor, a speed sensor configured to measure a rotational speed of the fan, and a control circuit comprising one or more processors and a memory structured to store instructions that, when executed by the one or more processors, cause the control circuit to: determine an active cooling capacity of the fan according to the measured rotational speed of the fan while the fan motor is in an active cooling mode; determine a passive cooling capacity of the fan according to the measured rotational speed of the fan after the fan motor is switched from the active cooling mode to an off mode; and control power to the fan motor to provide a target cooling load according to the active cooling capacity of the fan and the passive cooling capacity of the fan.

In some embodiments, the control system is a closed loop control system. In some embodiments, the speed sensor comprises a gear tooth sensor, an optical sensor, a magneto-resistive sensor, a Hall-effect sensor, or a combination thereof. In some embodiments, at least a portion of the speed sensor is provided on one or more of a fan rotor, the fan motor, and one or more of the fan blades.

In some embodiments, the control system is further configured to determine the active cooling capacity of the fan and the active cooling capacity of the fan according to at least one of a temperature and a density of an ambient air. In some embodiments, the control system is further configured the control system is further configured to provide a signal corresponding to a target fan speed to the fan motor. In some embodiments, the control system is further configured to provide a signal corresponding to a target fan power to the fan motor. In some embodiments, the control system is further configured to determine a resistive capacity of the resistor grid according to the active cooling capacity of the fan and the passive cooling capacity of the fan.

In some embodiments, the control circuit is configured to determine the passive cooling capacity of the fan according to the measured rotational speed of the fan after the fan motor is switched from the active cooling mode to an off mode, based on residual rotation of the fan from a first time instance in which the fan motor is switched to the off mode to a second time instance in which the fan is at rest.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain embodiments in detail, it should be understood that the present disclosure is not limited to the details or methodology set forth in the description or illustrated in the figures. It should also be understood that the terminology used herein is for the purpose of description only and should not be regarded as limiting.

Electric Drive Machine

Figure 1:
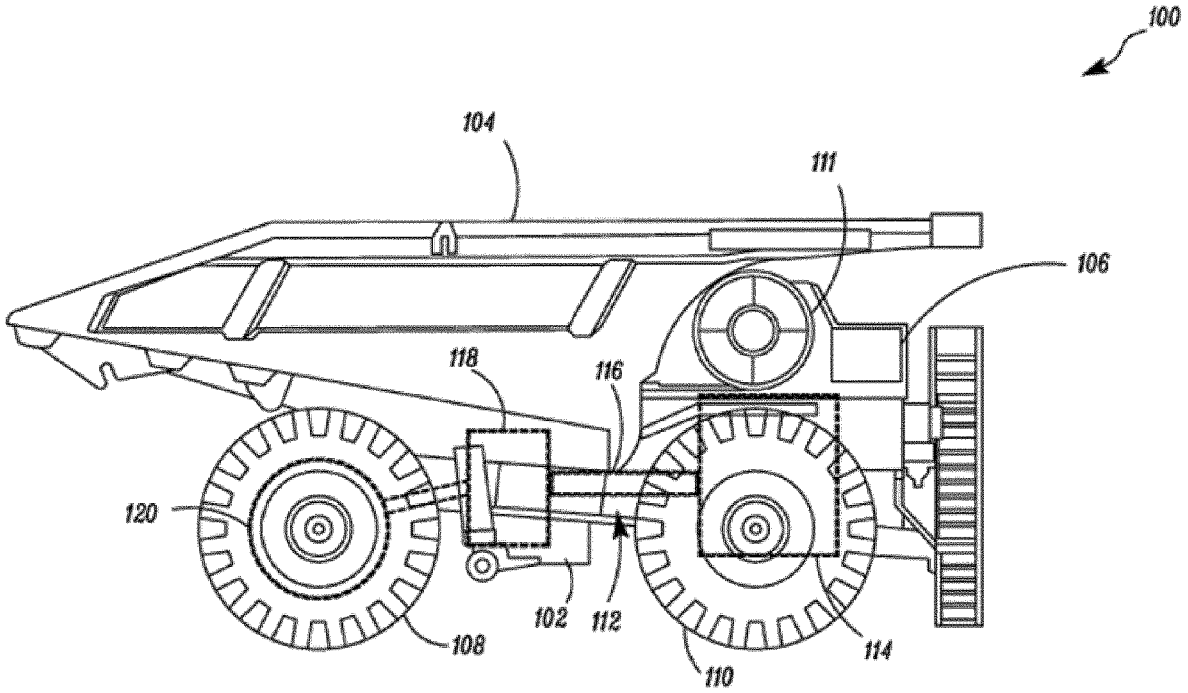
FIG. 1 is a side view of a machine, according to an embodiment of the present disclosure.

A machine 100 in which disclosed embodiments may be implemented is schematically illustrated in FIG. 1. The machine 100 may be generically described as any machine having an electric drive which may be connected to one or more drive wheels. The machine 100 may include a vehicle such as a diesel engine locomotive, a subway tram, an off-highway truck or a vehicle used in mining, construction, quarrying, and other applications. However, it will be apparent, any other vehicle having an electric drive or an electric-only arrangement may be included in the machine 100.

For the purpose of the present disclosure, in FIG. 1, the machine 100 is illustrated as an off-highway truck. The machine 100 may include a chassis 102 to support various components of the machine 100. The machine 100 may include a dump body 104 supported on the chassis 102. The chassis 102 may further support an operator cab 106 defined as an enclosure. An operator occupying the operator cab 106 may control various functions of the machine 100 by issuing various operator commands by means of controls such as a joystick, a lever, a touch-based user interface, or the like.

The machine 100 may further include a set of drive wheels 108 to propel the machine 100. In an embodiment, a set of idle wheels 110 may also be provided to steer the machine 100 in different directions. Further, the machine 100 may also include an articulated chassis for steering. Together, the set of drive wheels 108 and the set of idle wheels 110 may act as the ground engaging members for the machine 100. As illustrated in FIG. 1, the machine 100 also includes a modular resistor grid system 111 positioned adjacent to the operator cab 106 in the machine 100. However, it may be apparent, the modular resistor grid system 111 may be positioned anywhere based on the design and the available space in the machine 100.

The machine 100 of the present disclosure may be an electric machine having an electric drive 112. The electric drive 112 may provide the electric power to drive various components in the machine 100. In an embodiment, the electric power may be generated onboard by a generator, alternator, or another power-generation device, which may be driven by an engine or any other power source. Alternatively, the electric power may not be generated onboard but supplied externally from an overhead conductor via a pantograph trolley, a battery, a series of capacitors, or the like to drive the machine 100.

In the illustrated embodiment, the electric drive 112 includes a power source 114, which may be an engine, for example, an internal combustion engine such as a diesel engine, a gasoline engine, a natural gas engine or the like. The power source 114 may provide an output torque at an output shaft 116 in the machine 100. The output shaft 116 may be connected to a generator 118, which may be a multiple-phase alternating current (AC) synchronous alternator. During operation, the output shaft 116 rotates a rotor of the generator 118 to produce electric power, for example, in the form of alternating current (AC). This generated electric power may be used to run a plurality of drive motors 120 coupled directly or via intermediate assemblies to the set of drive wheels 108. For the purpose of the present disclosure, the drive motors 120 may be variable speed, reversible AC motors.

Electric Drive and Dynamic Breaking System

Figure 2:
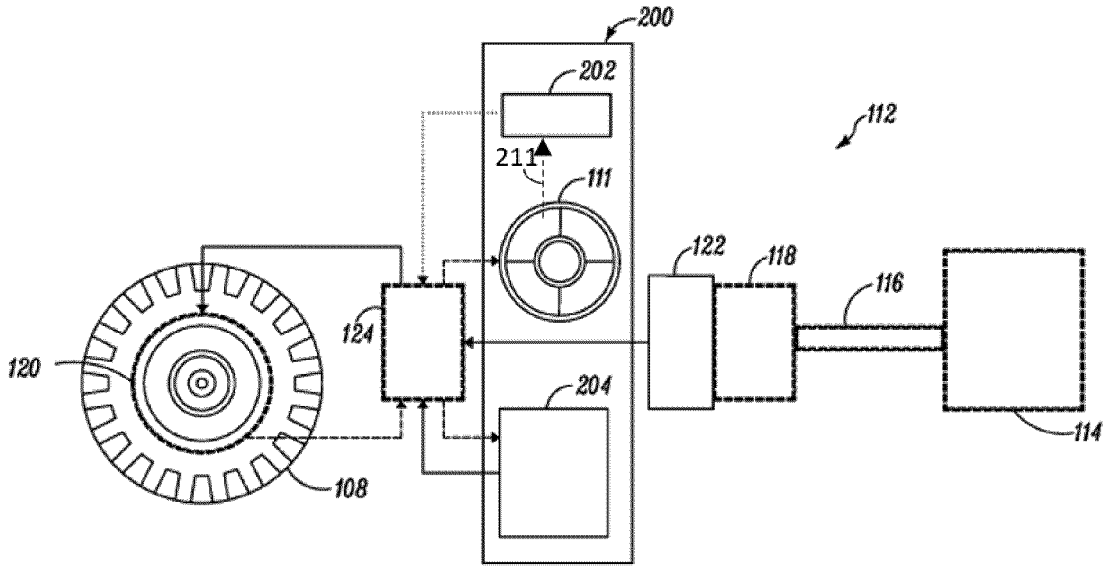
FIG. 2 is a schematic diagram of an electric drive for the machine of FIG. 1, according to an embodiment.

A schematic of the electric drive 112 is illustrated in FIG. 2. The electric drive 112 of the present disclosure may be a direct series drive. FIG. 2 illustrates an arrangement of various components of the electric drive 112 in the machine 100, according to an embodiment. In the schematic diagram, the flow direction of the electric power in the system is denoted by arrows. The solid-lined arrows denote the flow of the electric power when the machine 100 is being propelled. Conversely, the flow of the electric power during a braking mode of the machine 100 is denoted by dash-lined arrows in FIG. 2, while the dotted line arrow designates control line connection between components of the electric drive 112.

A person skilled in the art will understand that the generator 118 may produce electric power in the form of alternating current (AC) power. This electric power may be supplied to a rectifier 122 and converted to direct current (DC) power. The rectified DC power may be converted again to AC power by an inverter circuit 124. The inverter circuit 124 may be capable of selectively adjusting the frequency and/or pulse-width of the output, such that the drive motors 120 that are connected to an output of the inverter circuit 124 may be operated at variable speeds. In an embodiment, a plurality of inverter circuits 124 may be disposed in connection with the drive motors 120 in the machine 100.

FIG. 2 further illustrates a dynamic braking system 200 for the machine 100. The dynamic braking system 200 may be in connection with the drive motors 120 of the machine 100. Specifically, the dynamic braking system 200 may be operatively disposed in connection with the inverter circuit 124 in the machine 100. The dynamic braking system 200 may be configured to slow the propulsion of the machine 100 during braking mode as per an operator command in the machine 100.

According to the present disclosure, the dynamic braking system 200 may include a control unit 202, which may be a combination of, but not limited to, a hardware component, computing device, or other processing equipment, and memory, such as a Random Access Memory (RAM), a Read Only Memory (ROM), flash memory, a data structure, and the like. The control unit 202 may be configured to execute instructions (e.g., the processing equipment may be configured to execute the instructions stored on the data structure of the control unit 202). The control unit 202 may be configured to receive the operator command in the machine 100. Further, the control unit 202 may determine whether to put the machine 100 in the braking mode or not, based at least in part on the operator command. To initiate braking of the machine 100, the control unit 202 may generate a braking signal (illustrated by dotted line) for the inverter circuit 124. A dashed arrow represents optional signals, inputs, or data 211 that may be received by the control unit 202 from the resistor grid system 111 during operation.

The braking signal may be received by the inverter circuit 124 in the machine 100. The braking signal may carry instructions to reverse a torque polarity of the drive motors 120. This makes the drive motors 120 to act as generators, using the mechanical power in the form of rotational energy from the set of drive wheels 108 to produce electric power. This electric power may be supplied back to the electric drive 112 in the machine 100.

The dynamic braking system 200 may further be configured to provide regenerative braking in the machine 100. For this purpose, the dynamic braking system 200 may include an energy storage unit 204. The energy storage unit 204 may include a battery, a plurality of capacitors or the like disposed in connection with the drive motors 120 in the electric drive 112. As during braking mode, the drive motors 120 may produce electric power, the energy storage unit 204 may store this electric power for later use in the machine 100.

The present disclosure is applicable to many machines, for example, a large off-highway truck, such as a dump truck, which are commonly used in mines, construction sites and quarries. The machine 100 may have a high payload capability and a travel speed of a few miles per hour when fully loaded. The machine 100 may further be required to operate in a variety of environments, at a variety of altitudes, and to negotiate steep inclines in dry or wet conditions.

Typically, to halt or slow down such machines, friction-based brakes coupled to the set of drive wheels and idle wheels are used. These friction-based brakes are effective but may wear out with prolonged use. To overcome this, the dynamic braking system 200 of the machine 100 of the present disclosure may work in combination with or without these friction-based brakes. The dynamic braking system 200 may supplement these friction-based brakes in the machine 100 and thus helps in reducing the wear of such brakes.

The dynamic braking system 200 may act on the operator command to put the machine 100 in the braking mode. Specifically, the operator command may be received by the control unit 202 in the dynamic braking system 200. The control unit 202 generates the braking signal determined at least in part by the operator command. This determination or calculation may be based on various operating parameters of the machine 100, such as, the current speed, the current payload, the rate of acceleration, the desired speed and so forth.

Subsequently, the braking signal may be received by the inverter circuit 124 in the electric drive 112 of the machine 100. In the braking mode, the electric drive 112 may switch the torque polarity of the drive motors 120, which makes the drive motors 120 to act as generators. In this mode, the drive motors 120 may use the power from the set of drive wheels 108, which ultimately discharges the mechanical energy of the set of drive wheels 108 and achieves slowing or braking of the machine 100. Further, the drive motors 120, consuming the mechanical power from the set of drive wheels 108, may generate electric power in the electric drive 112.

This generated electric power may be fed to the dynamic braking system 200 in the electric drive 112. The generated electric power, which may be in the form of AC, may be fed via the inverter 124 which converts AC electric power into DC electric power. In an embodiment, with the machine 100 having regenerative braking, a part of the generated electric power may be supplied to the modular resistor grid system 111 to be dissipated as heat and the remainder of the generated electric power may be supplied to the energy storage unit 204 for later use in the machine 100.

Modular Resistor Grid System

Figure 3:
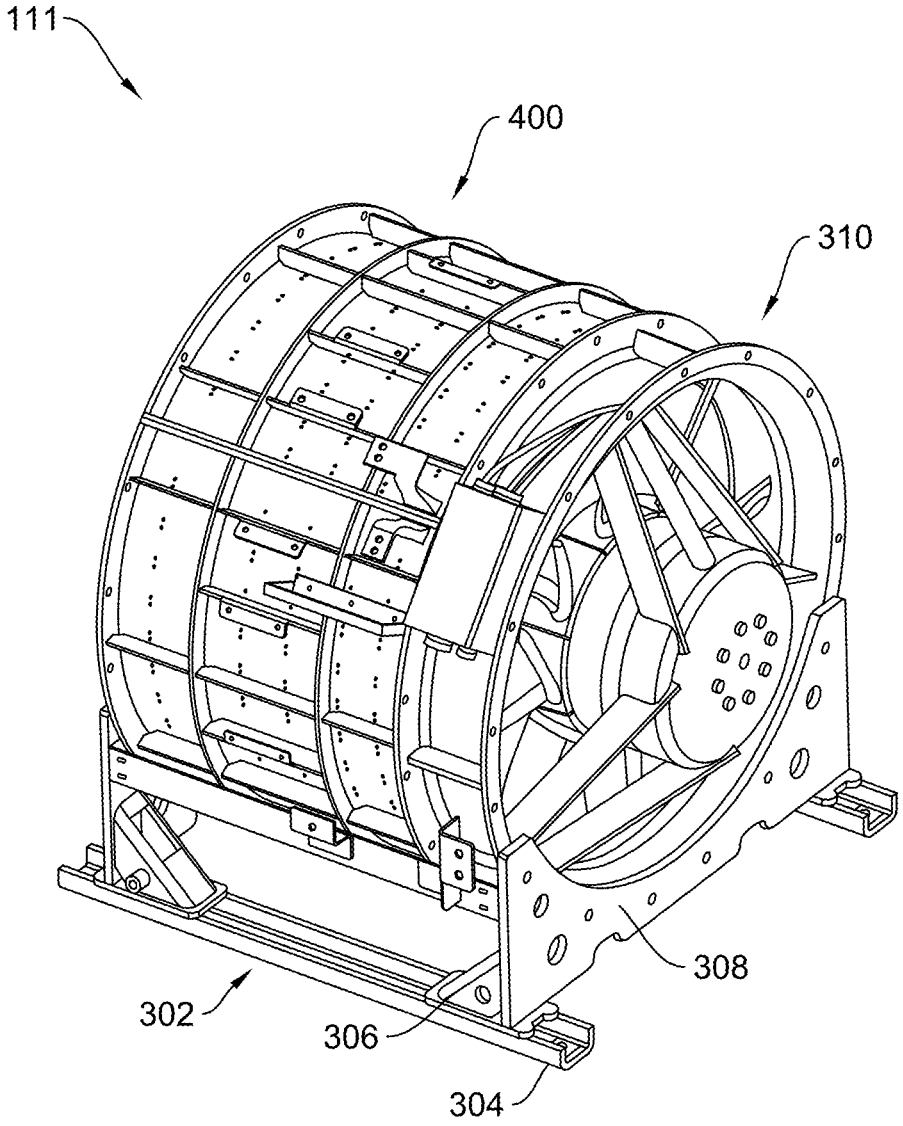
FIG. 3 is a perspective view of an exemplary modular resistor grid system, according to an embodiment.
Figure 4:
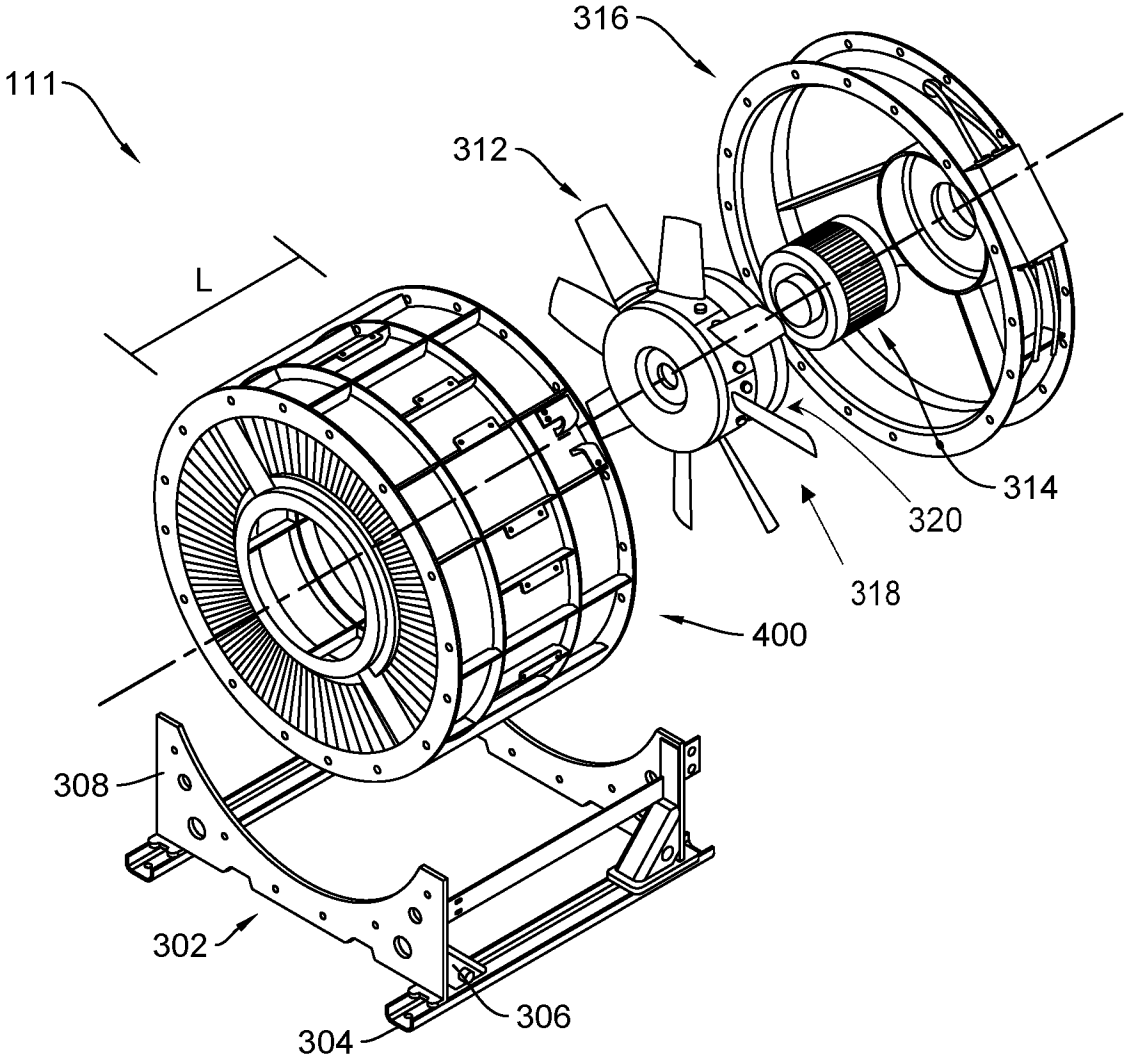
FIG. 4 is an exploded view of the modular resistor grid system of FIG. 3A.

The dynamic braking system 200 may include the modular resistor grid system 111. The modular resistor grid system 111 may dissipate some or all of the generated electric power in the form of heat. FIG. 3 illustrates a perspective view of the modular resistor grid system 111, according to an aspect of the present disclosure. FIG. 4 illustrates an exploded view of the modular resistor grid system of FIG. 3.

Referring to FIGS. 3 and 4, the modular resistor grid system 111 includes a mount 302, a fan 310, and a modular resistor grid assembly 400. The mount 302 may be permanently or removably coupled to the machine 100. The mount 302 provides a support structure upon which the other components of the modular resistor grid system 111 may be secured, connected, and/or coupled to the dynamic braking system 200 of the machine 100. The mount 302 may include a frame 304 and one or more brackets 306. The frame 304 may include rigid supporting members such as bars, rails, posts, tracks, or other suitable elements to affix the components of the modular resistor grid system 111 to the machine 100. The brackets 306 may be selectively moveable brackets 306 such that one or more brackets 306 can be fastened to a first position along the frame 304, loosened, allowed to slide along the length of the frame 304 to a second position, then tightened to secure the bracket 306 in the second position. The brackets 306 may also include a mounting feature 308 configured to align or abut with the components of the modular resistor grid system 111 such that the components may be fastened together by bolts, welds, or other suitable fasteners. For example, in FIGS. 3 and 4, moveable brackets 306 are coupled to mounting features 308 that are shaped to fit the cylindrical profile of the modular resistor grid system 111, according to an aspect of the present disclosure. In this way, multiple modular resistor grid assemblies 400 of varying axial length L may be coupled to the mount 302 by sliding and securing the moveable brackets 306 as needed along the frame 304.

The modular resistor grid system 111 also includes a fan 310. The fan 310 is configured to blow cooling air through the modular resistor grid assembly 400 in order to dissipate heat, for example, during a resistive braking mode of the machine 100. The fan 310 may include a blade assembly 312 configured to direct air towards or through the modular resistor grid assembly 400 as the blade assembly 312 rotates. The fan blade assembly 312 includes one or more blades 318 coupled to a support structure 320. The support structure may be a cylindrical sleeve or ring, as illustrated in FIG. 4, or may be structure known in the art for supporting fan blades. The one or more blades 318 of the fan blade assembly 312 are configured to push air when the blade assembly is rotated. A power source 314 (e.g., a motor, battery, etc.) may power the fan 310, and a hub assembly 316 may direct air towards the modular resistor grid assembly 400 and/or encase and protect the components of the fan 310. In some embodiments, the blade assembly 312 is caused to rotate by the power source 314. In other embodiments, the blade assembly 312 is coupled to a rotor (not shown) that is rotated by the power source 314, which then causes the blade assembly to rotate.

The modular resistor grid system 111 includes a modular resistor grid assembly 400. The modular resistor grid assembly 400 facilitates resistive braking by receiving and dissipating power from the machine 100 in the form of heat. In some embodiments, the modular resistor grid assembly 400 may be formed by as a single unit or may be formed from a single modular resistor grid. In other embodiments, the modular resistor grid assembly 400 may be formed by coupling together multiple modular resistor grids 402 (See, e.g., FIGS. 5 and 6 discussed below). The modular resistor grid assembly 400 includes a housing 404 which may provide support to various elements of the modular resistor grid system 111. In the illustrated example of FIGS. 3-5, the housing 404 has a cylindrical shape having an inner wall 406 and an outer wall 408. The housing 404 may be in any shape and may divided into one or more modular sections. For example, the housing 404 of the modular resistor grid assembly 400 may be formed by coupling together two or more modular resistor grids 402, each having a housing 404 encasing one or more resistor elements 410. The modular resistor grids 402 may be cylindrical, semicylindrical, quadrant-shaped, wedge-shaped, triangular, or other suitable shapes. The number of subsections of housing 404 and the number of individual modular resistor grids 402 that may be coupled together to form the modular resistor grid assembly 400 may vary depending on the space constraints in the machine 100.

Figure 5:
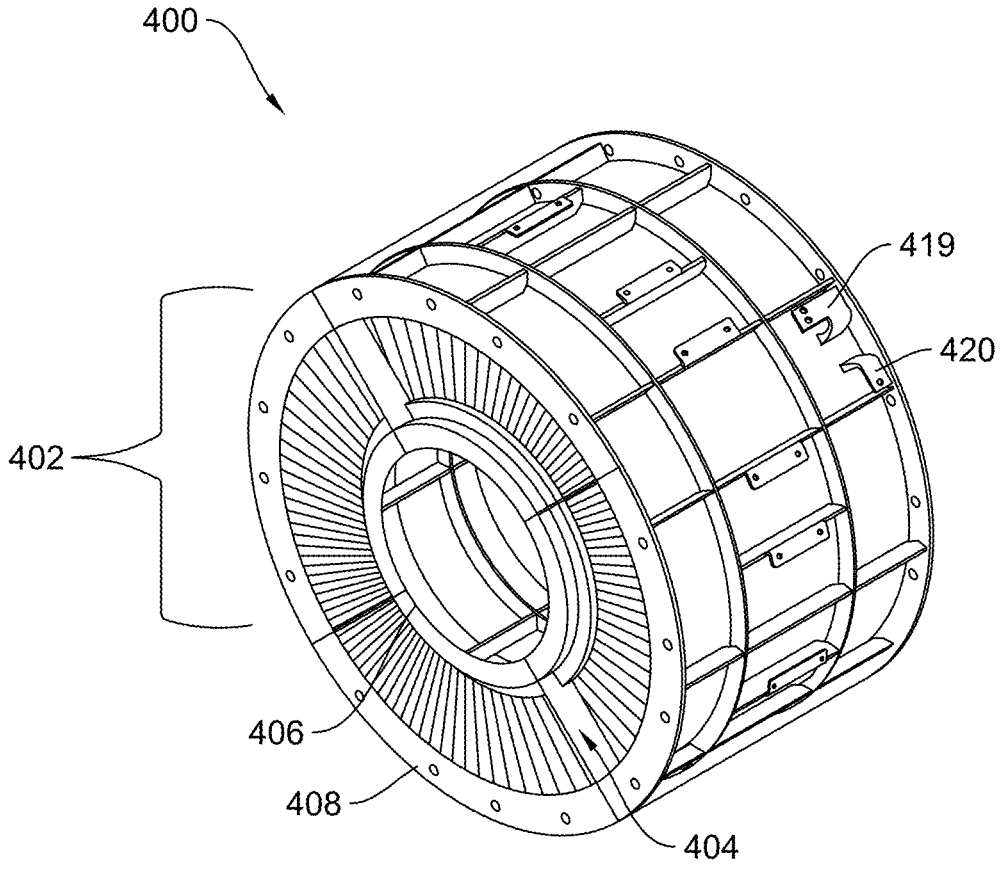
FIG. 5 is a perspective view of a modular resistor grid assembly, according to an embodiment.
Figure 6:
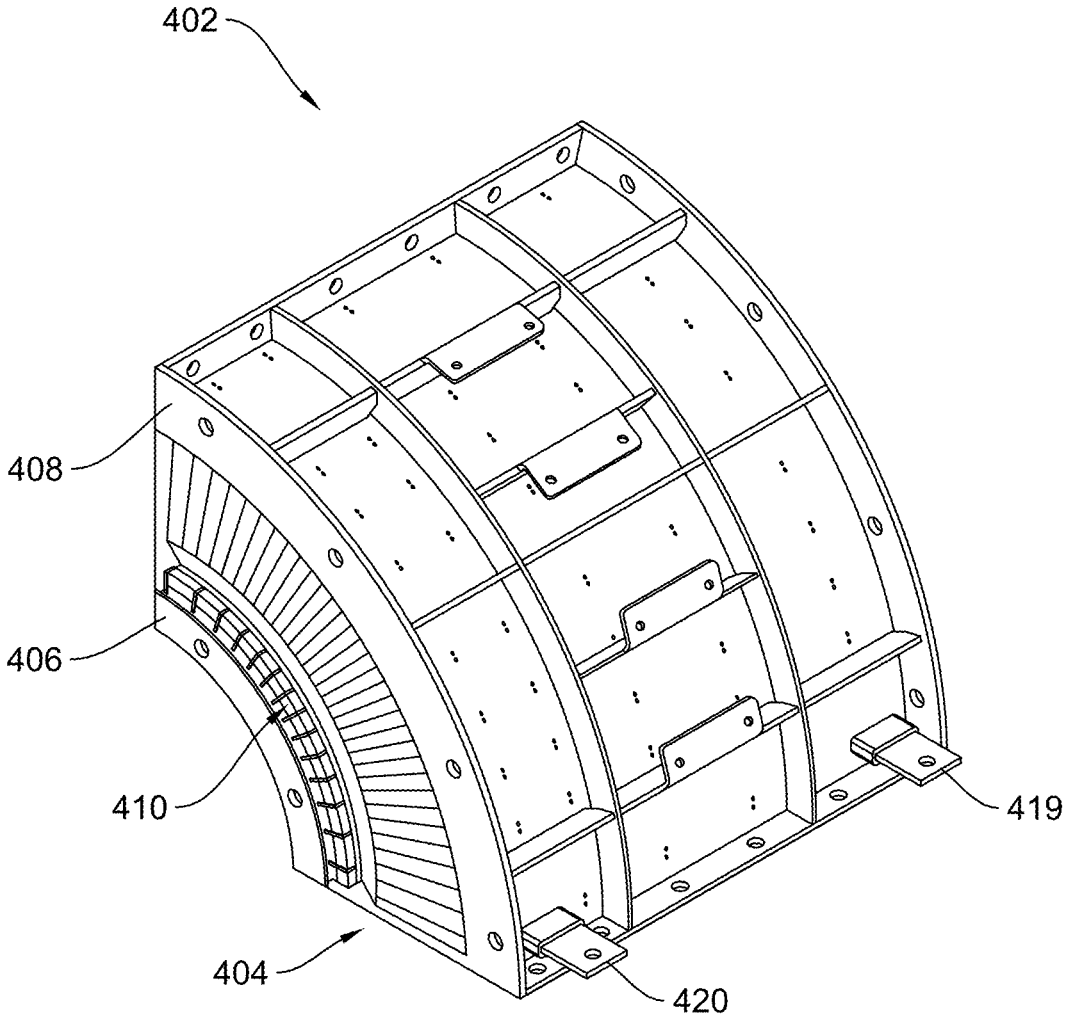
FIG. 6 is perspective view of a modular resistor grid of the modular resistor grid assembly of FIG. 5, according to an embodiment.

For example, FIG. 5 and FIG. 6 illustrate an embodiment of the modular resistor grid assembly 400 that is divided into four quadrant-shaped modular resistor grids 402, which are assembled with each other in the machine 100. The modular resistor grid assembly 400 and the modular resistor grid 402 include at least one resistor element 410 disposed between the inner wall 406 and the outer wall 408 of the housing 404. The modular resistor grid assembly and/or the modular resistor grid 402 may include two or more resistor elements 410 (e.g., a plurality of resistor elements 410) that are closely packed in a stacked configuration abutting in an end-to-end orientation. The resistor elements 410 may be uniformly arranged in the housing 404 to maintain air spaces between each other. This uniform spacing assures an adequate flow of cooling air between the resistor elements 410 in the modular resistor grid system 111. Moreover, one or more cooling air vents may be provided in the housing 404 for circulation of cooling air in the modular resistor grid system 111.

Figure 7:
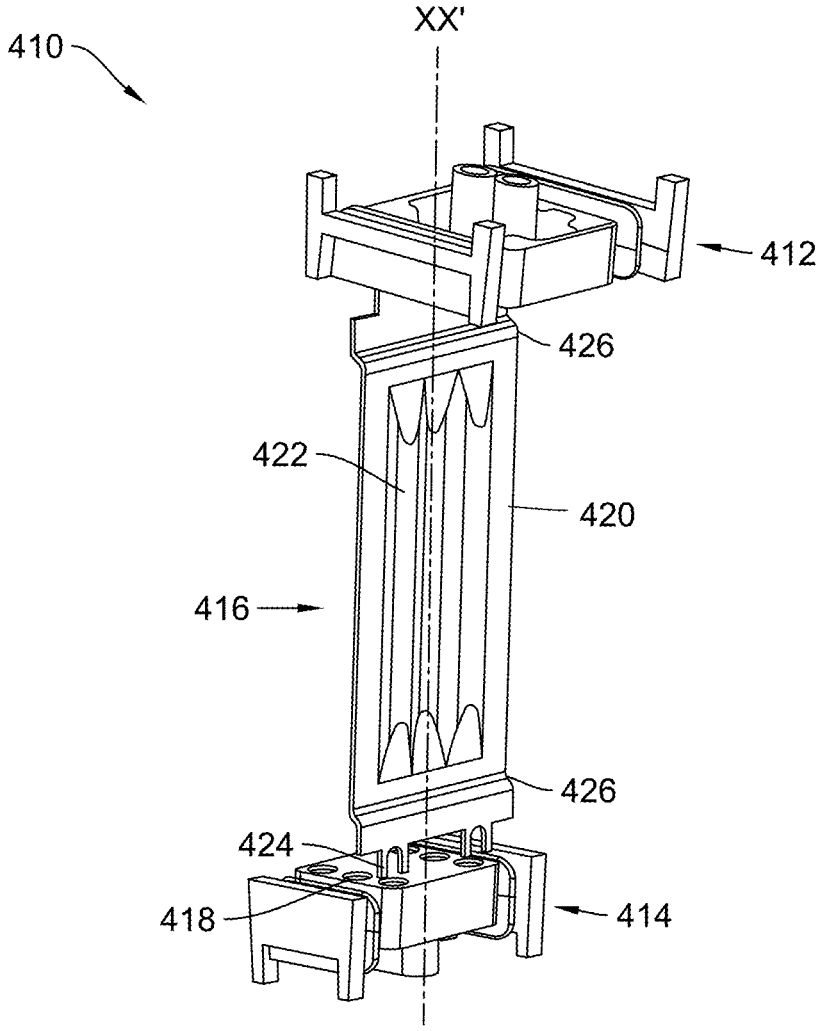
FIG. 7 is a perspective view of a resistor element, according to an embodiment.

FIG. 7 illustrates an resistor element 410 according to an embodiment. The resistor element 410 includes a first insulator 412, a second insulator 414, and one or more resistor plates 416 mounted to the first insulator 412 and the second insulator 414. In the example illustrated, the resistor plate 416 is mounted between the first insulator 412 and the second insulator 414, which in turn may be affixed to the inner wall 406 and the outer wall 408 of the housing 404 of the modular resistor grid assembly 400 and/or the modular resistor grid 402. Further, the one or more resistor elements 410 may be arranged in one or more rows, substantially parallel to each other in a close face-to-face relationship forming an axial airflow path therebetween. Multiple resistor plates 416 of the resistor element 410 may be connected in series within each modular resistor grid 402 and/or the modular resistor grid assembly 400 to provide a continuous current path between an input terminal 419 and an output terminal 420 (See FIGS. 5 & 6) of the modular resistor grid 402 and/or the modular resistor grid assembly 400. For this purpose, a conducting member may be disposed in the housing 404, electrically connecting the two or more resistor plates 416 in the modular resistor grid system 111. The conducting member may be a conductive wire, a weld, etc. The resistor units 410 may be connected in a manner such that the modular resistor grid system 111 may have two current circuits, a contactor power circuit and a chopper power circuit.

As illustrated, the first insulator 412 and the second insulator 414 may be in the shape of a block made of insulating material such as silicon bonded laminated mica, ceramic, glass reinforced material, etc. However, any other material with insulating properties may be used to form the first insulator 412 and the second insulator 414. The first insulator 412 may be affixed to the outer wall 408 of the housing 404 by some fastening member, such as, nuts and bolts, screws, etc. The second insulator 414 may be similarly fastened to the inner wall 406 of the housing 404. The first insulator 412 and the second insulator 414 may each include one or more apertures 418 formed therein. Further, the apertures 418 may not be extending through the first insulator 412 or the second insulator 414 and may be configured to receive and mount the resistor plate 416 between the first insulator 412 and the second insulator 414.

The resistor plate 416 may be formed from a continuous strip of resistive material such as stainless steel. The resistor plate 416 may include a body portion 428 extending along a longitudinal direction XX' of the resistor plate 416. In an embodiment, the resistor plate 416 may also include a series of reflexed portions 422 disposed at opposite longitudinal sides in the body portion 428 of the resistor plate 416. In some configurations, the resistor plate 416 may extend in the range of about 150 millimeters to about 200 millimeters along the longitudinal direction XX'. In a specific example, the resistor element 404 may have a length of about 160 millimeters. The resistor plate 416 may have a tip portion 424 disposed at an end 426 off the body portion 428. Alternatively, the resistor plate 416 may include two or more tip portions 424 disposed from both the ends 426. The tip portions 424 of the resistor plate 416 may be adapted to be received in the apertures 418 of the first insulator 412 and the second insulator 414. The apertures 418 may provide some clearance for movement of the tip portions 424 within. This allows for the resistor plate 416 to move in the longitudinal direction XX' in the resistor element 410 upon thermal expansion and thermal contraction.

During a resistive braking mode, the generated electric power may pass into the modular resistor grid system 111 via the input terminal 419 and flow through the resistor plates 416 in the resistor element 410 of the modular resistor grid system 111 to be dissipated as heat. Specifically, the heat is generated by the body portion 428 of the resistor plate 416. This generated heat may be radiated to the first insulator 412 and the second insulator 414 and raise the temperature of the first insulator 412 and the second insulator 414 in the resistor element 410. The normal continuous operating temperature for the first insulator 412 and the second insulator 414 is in the range of 300 to 400 degrees Celsius, according to industry standards. For short intervals, the temperature of the first insulator 412 and the second insulator 414 may reach higher values due to surges, but if the temperature rises above a critical or maximum operating temperature for extended periods of time, the lifetime of the first insulator 412 and the second insulator 414 may be greatly reduced. Further, the mechanical stability of the resistor plates 416 may be compromised, causing the resistor plates 416 to bend and ultimately leading to rapid failure of the dynamic braking system 200.

Measured Fan Speed and Control

With continued reference to FIG. 2-FIG. 7, in operation, during a resistive braking event, a braking signal is sent to the inverter circuit 124, causing the circuit to reverse a torque polarity of drive motors (not depicted) coupled to the inverter circuit, thereby providing braking to the vehicle and causing the drive motors to produce electrical charge. Excess electrical charge is directed to the resistor grid system 111 to be dissipated as heat.

The amount of power that the resistor grid system is able to reject is the power capacity of the system. The power capacity of the resistor grid system 111 may depend on several variables, including, but not limited to, the length of the electrical pathway provided by the resistor elements, the resistor grid materials, the duty or operating speed of the fan, convection considerations, such as the geometry of the angles and faces presented by the grid elements to the crossing air flow provided by the fan operation, among other variables. The resistor grid system 111 may have a power capacity of about 100 kW to about 100 MW.

The convective cooling provided by the resistor grid fan 310 to the resistor grid may increase the power capacity of the resistor grid system 111. A resistor grid fan 310 operates to blow air across the resistor elements when the resistor grid is providing resistive braking, thereby transferring heat from the resistor grid elements 410. The resistor grid fan 310 operates when power is supplied to it. The amount or frequency of power provided to the resistor grid fan is controlled by a fan control circuit. In some embodiments, the speed of the fan 310 is dependent on the voltage of power provided. In other embodiments, the speed of the fan 310 is dependent on the frequency of power provided to the fan (e.g., via a pulse-width modulated signal or some other frequency-based power signal). In some embodiments, the speed of the fan is a function of a combination of the voltage and the frequency of the power provided to the fan 310. In some embodiments, the fan is configured to received direct current (DC) from the power supply 314 via the fan control circuit. In other embodiments, the fan is configured to receive alternative (AC) from the power supply via the fan control circuit.

In some embodiments, the fan control circuit is configured to operate the fan 310 in a single mode of operation, where the fan 310 operates at full rotational speed when power is supplied to the fan. In other embodiments, the fan control circuit is configured to operate the fan 310 in a variable control scheme, allowing the fan 310 to operate at different rotational speeds based on the amount or frequency of power supplied thereto. In some embodiments, the fan 310 or the fan control circuit 500 may include circuitry to spin up the fan at a set rate of acceleration. In some embodiments, the fan control circuit 500 may include circuitry to spin up the fan 310 to a set speed.

The resistor grid fan 310 is configured to allow the blade assembly 312 to continue to rotate for some time even after power to the fan has been turned off. After power is no longer provided to the resistor grid fan 310, the residual rotation of the fan (e.g., as the fan 310 no longer has power supplied thereto and thus gradually decreases rotational speed) continues to provide a non-trivial amount of convective cooling to the resistor grid assembly 400 in general, and to the resistor grid elements 410 in particular, until the blade assembly 312 stops spinning or power is again provided to the fan. The speed of the unpowered fan 310 naturally decays over time during which the fan spins down. The amount of cooling passively provided by the resistor grid fan 310 during natural decay can be determined by measuring the speed of rotation of the blade assembly 312 as a function of time. By measuring the speed of rotation as a function of time, the amount of cooling passively provided by the resistor grid fan 310 can be determined for various power on/power off operations and scenarios.

In this way, the power duty of the resistor grid assembly 111 may be met through a combination of active cooling, during which the resistor grid fan 310 is powered, and passive cooling, during which the resistor grid fan 310 is unpowered but continues to spin. Thus, the resistor grid fan 310 may be utilized some fraction of time less than if the power duty of the resistor grid is provided solely by active cooling by the fan. This can serve to reduce the duty of the fan as a compared to the operation of the vehicle, thereby increasing the operating lifetime of the fan and reducing the amount of noise produced by the fan during operation of the vehicle.

Figure 8:
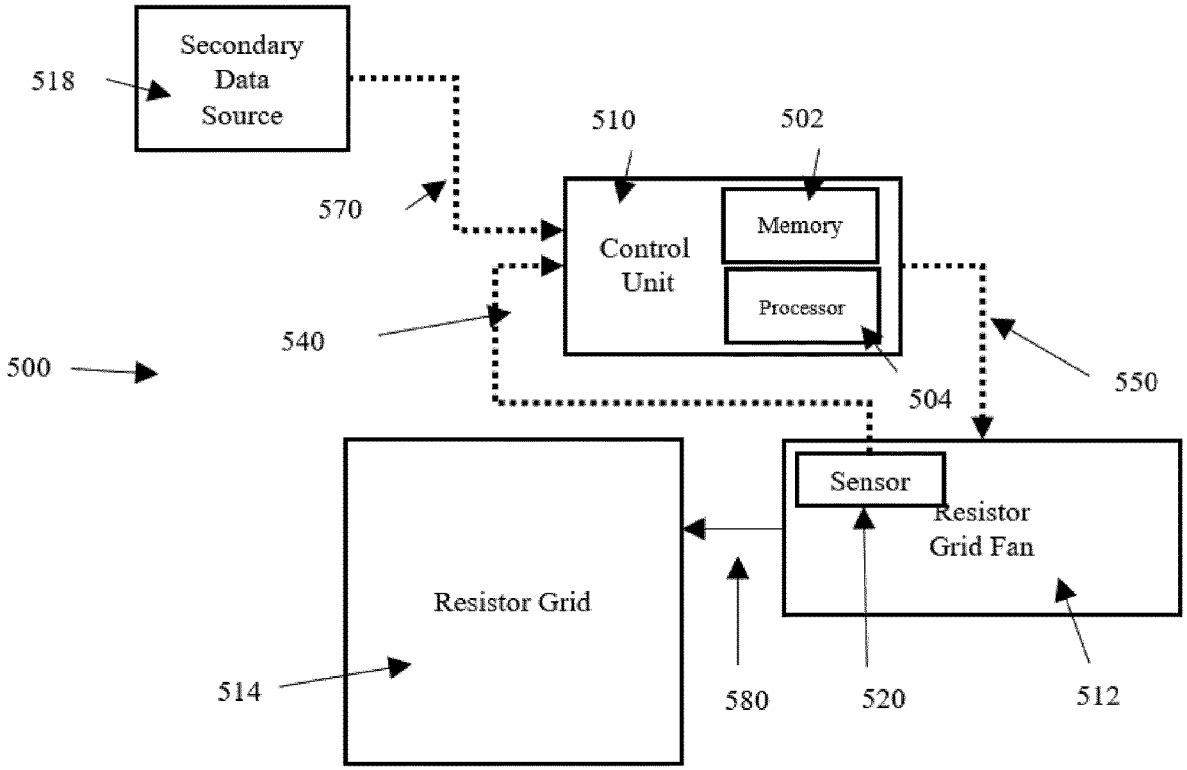
FIG. 8 is a schematic of a resistor grid control system, according to an embodiment.

One embodiment of a suitable fan control circuit is illustrated as a schematic in FIG. 8. In FIG. 8, the fan control circuit 500 is configured to provide control of a resistive braking system of a vehicle including a power source, drive motors, and inverter, and a resistor grid system including a resistor grid fan, as previously described, while receiving data regarding the operation of the resistor grid system such as the speed of the resistor grid fan. The fan control circuit 500 includes a control unit 510, which includes one or more processors 504 and a computer memory 502. The control unit may be a combination of, but not limited to, a set of instructions stored on a computer memory 502, one or more processors 502 configured to execute the set of instructions, a Random Access Memory (RAM), a Read Only Memory (ROM), flash memory, a data structure, and the like.

The control unit 510 is in electronic communication with one or more fan speed sensors 520 and with the resistor grid fan 512. The control unit 510 is configured to receive and output signals. The control unit 510 is able to send an operation signal 550 to the resistor grid fan 512. The operation signal may be an electronic signal setting a speed set point or an acceleration set point for the fan. During operation, the resistor grid fan provides convective cooling 580 to the resistor grid 514.

The memory 502 stores code that, when executed by the one or more processors 504, sends signals that control the operation of the fan 310. The fan control circuit 500 includes a speed sensor 520 for measuring the rotational speed of the fan. The fan speed sensor 520 may be placed in or adjacent to the resistor grid assembly 310. The fan speed sensor provides speed data 540 as a signal to the control unit.

The fan speed sensor may measure the speed of one or more of the fan blades 318, the speed of the support structure 320 of the fan blade assembly 310, or the speed of a rotor (not shown) of the fan 310. In various embodiments, other portions of the fan 310 may be suitable for determining the rotational speed of the fan. Any type of sensor known in the art suitable to determine the speed of an object may be used. As a non-limiting example, in some embodiments, the fan speed sensor 520 is a gear tooth sensor. In other embodiments, the fan speed sensor 520 is an optical sensor, a magneto-resistive sensor, or a Hall-effect sensor. An optical sensor may be undesirable when the vehicle is operated in a dusty environment, as the dust may interfere with accurate measurement of the fan speed. While this disclosure references a single sensor, it should be understood that it is possible to combine multiple speed sensors and use the combined data provided thereby. Measuring the speed of multiple resistor grid fan locations may increase the redundancy of the data and improve the data fidelity.

The fan control system 500 may include one or more secondary data sources 518. The secondary data sources may include, but not be limited to, remote or local databases or servers, processors, memory, and/or local or remote sensors. For example, the control unit 510 may receive a signal 570 corresponding to the temperature of the ambient air around the vehicle, the density of the ambient air around the vehicle, the elevation at which the vehicle is operating, the time of day, or information regarding the planned route of the vehicle. Even though a single source 518 is shown, it should be understood that each of these data signals could be provided by a separate sensor or other data source, such as a temperature sensor configured to measure the temperature of the ambient air around the vehicle or an altimeter configured to measure the elevation at which the vehicle is operating. It should also be understood that a single source may provide multiple data points. For example, a remote server may transmit a signal providing data on the elevation of the vehicle and the ambient air density or pressure.

The control unit 510 is further configured to send a braking signal 550 to the inverter circuit 512. The braking signal may be received by an inverter circuit in the vehicle. The braking signal may carry instructions to reverse a torque polarity of drive motors (not depicted) coupled to the inverter circuit, thereby providing braking to the vehicle and causing the drive motors to produce electrical charge. Excess electrical charge may be directed to a battery for storage and/or to the resistor grid 514 to be dissipated as heat.

The control unit 510 may be configured to determine, using the one or more processors and memory, the active and passive cooling capacities or duties of the resistor grid fan 512 according to the measured fan speed data associated with the resistor grid fan 514, as measured by the speed sensor 520. The active cooling capacity may be determined when the fan 512 is receiving power and is actively cooling the resistor grid 514. The passive cooling capacity may be determined after power is no longer being provided to the fan but the fan 512 continues to rotate, thereby providing cooling to the resistor grid 512. In some embodiments, the measured fan speed is the rotational speed of one or more fan elements, such as a blade, blade assembly, or rotor. In other embodiments, the measured fan speed is the rotational speed of a blade on the blade assembly. In some embodiments, the measured fan speed is a rotational speed of other parts of the resistor grid fan 512 such as a gear.

With continued reference to FIG. 8, the control unit 510 optionally may be configured to determine the active and passive cooling capacities of the resistor grid fan 512 according to other available data, such as the ambient air temperature, the ambient air density, the ambient air pressure, the elevation at which the vehicle is operating, the vehicle's planned route, among other possibilities. Other variables may also be accounted for in determining the active and passive cooling capacities of the resistor grid fan 512.

The control circuit may be configured to provide an output signal 560 to an interface or network (not shown). Information determined by, calculated by, derived by, identified by, or otherwise present in the control unit 510 can thus be transmitted by an output signal to other devices. In some embodiments, the interface is a user interface such as a graphical display. A display may be positioned in the cab showing the active and passive cooling capacities of the resistor grid fan 512, if desired. For example, an operator may determine available passive cooling capacity by the resistor grid fan, so as avoid actively using the fan to provide cooling to the resistor grid in certain operating environments. This may reduce the amount of noise produced by the fan in these operating environments.

Figure 9:
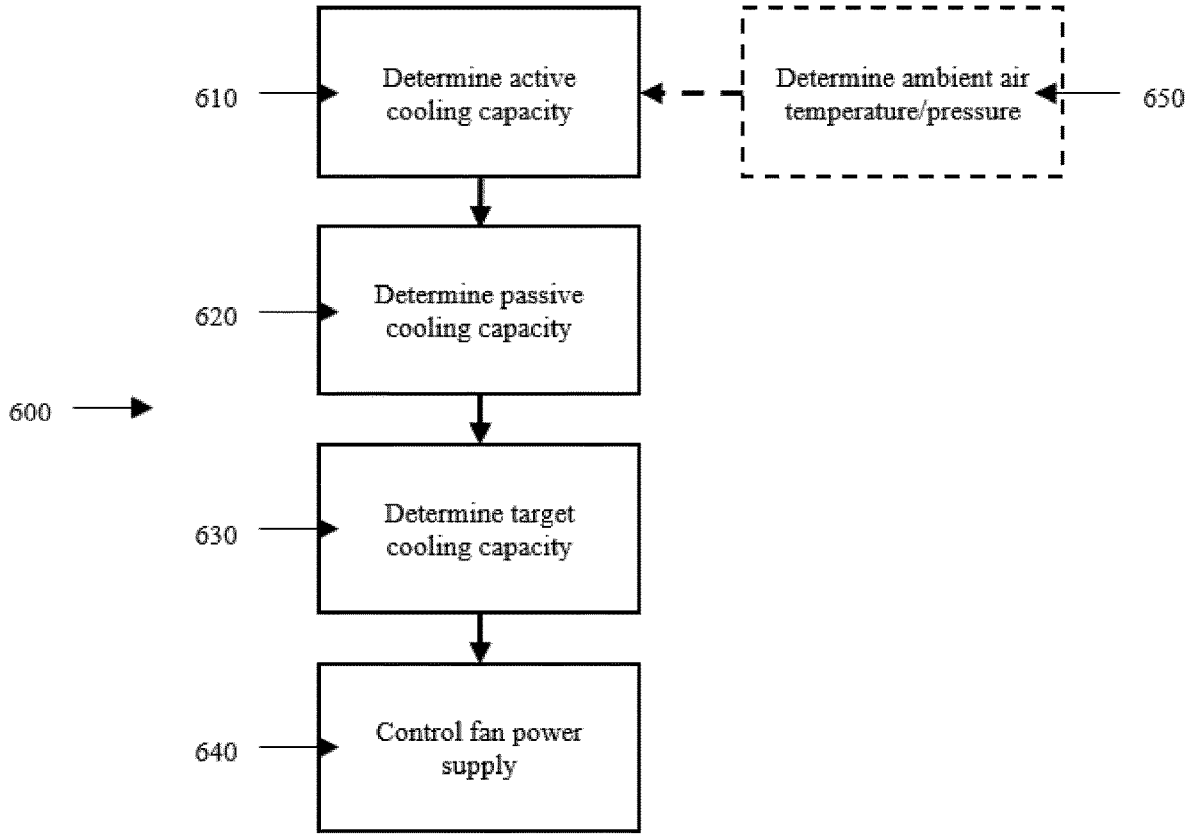
FIG. 9 is a schematic of a method of operating a resistor grid system, according to an embodiment.

These principles can be applied to a method of operating a vehicle with a resistive braking system utilizing a fan to increase the resistive braking capacity. With reference to FIG. 9, a method 600 of operating such a vehicle is shown according to an example embodiment. In the first step 610, one or more processors on the vehicle may determine the active cooling capacity of the fan associated with the resistive braking system providing resistive braking capacity to the vehicle. As described above, the cooling capacity of the fan may be determined in accordance with the rotational speed of the fan, e.g., as measured by a sensor positioned near or inside the resistor grid system.

Once the active cooling capacity of resistor grid fan is determined, in a second step 620, the one or more processors may determine the passive cooling capacity of the resistor grid system according to rotational speed of the fan over time while the fan is not receiving power. A sensor is used to measure the speed of the fan over time, and may be positioned adjacent, on, or inside the resistor grid system. In step 630, a target cooling capacity for the fan is determined by the one or more processors. The target cooling capacity represents the total amount of capacity that must be met by the convective cooling provided by the fan, both during active and passive use. The target cooling capacity may be constrained by a given or input time duration. For example, the target cooling capacity may be determined for a duration of 1 second, 15 second, 30 seconds, 1 minute, 2 minutes, 5 minutes, 10 minutes, 15 minutes, or any temporal value in between these values. The fan is controlled in step 640 so as to provide the target cooling capacity using a combination of active cooling capacity and passive cooling capacity.

In some embodiments, the method may include step 650, where the one or more processors determine the temperature and/or pressure of the ambient air in which the vehicle is operating. The peak power capacity of the resistor grid system may also be rendered by the one or more processors on a display available to an operator of the vehicle, thereby providing additional information to the operator regarding the potential capacity of the braking systems. Alternatively or additionally, the density of the ambient air may also be taken into account by this method.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

The hardware and data processing components used to implement the various processes, operations, illustrative logics, logical blocks, modules, and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the various exemplary embodiments is illustrative only. Additionally, any element disclosed in one embodiment may be incorporated or utilized with any other embodiment disclosed herein.

What is claimed is:

1. A system comprising:

a resistor grid electrically coupled to a motor of an electric drive machine;

a fan including a plurality of fan blades rotatably coupled to a fan motor;

a speed sensor configured to measure a rotational speed of the fan; and a control circuit comprising one or more processors and a memory structured to store instructions that, when executed by the one or more processors, cause the control circuit to:

determine an active cooling capacity of the fan according to a measured rotational speed of the fan while the fan motor is in an active cooling mode;

determine a passive cooling capacity of the fan according to a measured rotational speed of the fan after the fan motor is switched from the active cooling mode to an off mode;

determine a target cooling load to meet a power duty of the resistor grid;

determine a target cooling capacity using a combination of the active cooling capacity and the passive cooling capacity; and control power to the fan motor to provide the target cooling load, using the combination of the active cooling capacity of the fan and the passive cooling capacity of the fan, the combination providing the target cooling capacity corresponding to the target cooling load.

2. The system of claim 1, wherein the speed sensor comprises a gear tooth sensor, an optical sensor, a magnetoresistive sensor, a Hall-effect sensor, or a combination thereof.

3. The system of claim 1, wherein the speed sensor is at least partially provided on one or more of a fan rotor, the fan motor, or one or more of the plurality of fan blades.

4. The system of claim 1, wherein the control circuit is further configured to determine the active cooling capacity of the fan and the passive cooling capacity of the fan according to at least one of a temperature and a density of an ambient air.

5. The system of claim 1, wherein the control circuit is further configured to provide a signal corresponding to a target fan speed to the fan motor.

6. The system of claim 1, wherein the control circuit is further configured to provide a signal corresponding to a target fan power to the fan motor.

7. The system of claim 1, wherein the control circuit is further configured to determine a resistive capacity of the resistor grid according to the active cooling capacity of the fan and the passive cooling capacity of the fan.

8. The system of claim 7, wherein an amount of time that the fan is operated in the active cooling mode is reduced compared to when the target cooling load is provided by the active cooling capacity alone.

9. The system of claim 1, wherein the control circuit is configured to determine the passive cooling capacity of the fan according to the measured rotational speed of the fan after the fan motor is switched from the active cooling mode to the off mode, based on residual rotation of the fan from a first time instance in which the fan motor is switched to the off mode to a second time instance in which the fan is at rest.

10. A method of operating an electric drive machine, the method comprising:

determining, by one or more processors, an active cooling capacity of a fan coupled to a resistor grid, wherein the active cooling capacity of the fan is determined when the fan is receiving power and is in an active cooling mode;

determining, by the one or more processors, a passive cooling capacity of the fan coupled to the resistor grid, wherein the passive cooling capacity of the fan is determined after the fan is switched from the active cooling mode to an off mode;

determining, by the one or more processors, a target cooling load to meet a power duty of the resistor grid;

determining, by the one or more processors, a target cooling capacity using a combination of the active cooling capacity and the passive cooling capacity; and controlling, by the one or more processors, power to the fan to provide the target cooling load to the resistor grid, using the combination of the active cooling capacity of the fan and the passive cooling capacity of the fan, the combination providing the target cooling capacity corresponding to the target cooling load.

11. The method of claim 10, further comprising measuring a temperature of an ambient air, wherein the passive cooling capacity and the active cooling capacity of the fan is determined according to the temperature of the ambient air.

12. The method of claim 10, wherein controlling power to the fan to provide the target cooling load includes operating the fan in the active cooling mode for an amount of time that is reduced compared to when the target cooling load is provided by the active cooling capacity alone.

13. The method of claim 10, further comprising determining, by the one or more processors, a resistive capacity of the resistor grid according to the active cooling capacity of the fan and the passive cooling capacity of the fan.

14. The method of claim 10, wherein determining the passive cooling capacity of the fan is according to a measured rotational speed of the fan as a function of time after the fan is switched from the active cooling mode to the off mode, based on residual rotation of the fan from a first time instance in which the fan is switched to the off mode to a second time instance in which the fan is at rest.

15. An electric drive machine comprising:

a resistor grid electrically coupled to a motor of the electric drive machine;

a fan including a plurality of fan blades rotatably coupled to a fan motor;

a speed sensor configured to measure a rotational speed of the fan; and a control circuit comprising one or more processors and a memory structured to store instructions that, when executed by the one or more processors, cause the control circuit to:

determine an active cooling capacity of the fan according to a measured rotational speed of the fan while the fan motor is in an active cooling mode;

determine a passive cooling capacity of the fan according to a measured rotational speed of the fan after the fan motor is switched from the active cooling mode to an off mode;

determine a target cooling load to meet a power duty of the resistor grid;

determine a target cooling capacity using a combination of the active cooling capacity and passive cooling capacity; and control power to the fan motor to provide the target cooling load, using the combination of the active cooling capacity of the fan and the passive cooling capacity of the fan, the combination providing the target cooling capacity corresponding to the target cooling load.

16. The electric drive machine of claim 15, wherein the control circuit is a closed loop control system.

17. The electric drive machine of claim 15, wherein the speed sensor comprises a gear tooth sensor, an optical sensor, a magneto-resistive sensor, a Hall-effect sensor, or a combination thereof.

18. The electric drive machine of claim 15, wherein at least a portion of the speed sensor is provided on one or more of a fan rotor, the fan motor, and one or more of the plurality of fan blades.

19. The electric drive machine of claim 15, wherein the control circuit is further configured to determine the active cooling capacity of the fan and the active cooling capacity of the fan according to at least one of a temperature and a density of an ambient air.

20. The electric drive machine of claim 15, wherein the control circuit is further configured to provide a signal corresponding to a target fan speed to the fan motor.

21. The electric drive machine of claim 15, wherein the control circuit is further configured to provide a signal corresponding to a target fan power to the fan motor.

22. The electric drive machine of claim 15, wherein the control circuit is further configured to determine a resistive capacity of the resistor grid according to the active cooling capacity of the fan and the passive cooling capacity of the fan.

23. The electric drive machine of claim 15, wherein the control circuit is configured to determine the passive cooling capacity of the fan according to the measured rotational speed of the fan after the fan motor is switched from the active cooling mode to the off mode, based on residual rotation of the fan from a first time instance in which the fan motor is switched to the off mode to a second time instance in which the fan is at rest.

* * * * *